United States Patent [19]

Rundell et al.

[11] Patent Number: 4,480,688

[45] Date of Patent: Nov. 6, 1984

[54] METHOD AND BRIDGE PLUG FOR SEALING OFF A WELL

[75] Inventors: Herbert A. Rundell; Ronald L. Campsey, both of Houston, Tex.

[73] Assignee: Texaco Inc., White Plains, N.Y.

[21] Appl. No.: 446,096

[22] Filed: Dec. 2, 1982

[51] Int. Cl.[3] ..... E21B 33/129

[52] U.S. Cl. ..... 166/123; 166/382; 166/217

[58] Field of Search ..... 166/135, 138, 216, 217, 166/117, 202, 382, 301, 191, 181, 123; 277/216, 221, 222

[56] References Cited

U.S. PATENT DOCUMENTS

| | | | |
|---|---|---|---|
| 1,117,669 | 11/1914 | Hall | 166/217 X |
| 1,137,205 | 4/1915 | Hall | 166/217 X |
| 1,452,645 | 4/1923 | Klein | 277/222 |
| 2,618,345 | 11/1952 | Tucker | 166/135 X |
| 2,646,845 | 7/1953 | Schillinger | 166/202 X |

*Primary Examiner*—Stephen J. Novosad
*Assistant Examiner*—Bruce M. Kisliuk
*Attorney, Agent, or Firm*—Robert A. Kulason; Jack H. Park; Henry C. Dearborn

[57] ABSTRACT

A method for sealing off a section of tubing deep in a well comprises (1) permanently anchoring a tapered anchor in the tubing by lowering a beaded chain ring thereover for wedging the tapered anchor to the tubing at the desired position of sealing off of the tubing, and (2) fixedly attaching a bridge plug to the tubing by actuation of attaching means to the anchor for sealing off the section of tubing at the desired position. Likewise disclosed are a new bridge plug assembly, a new method for fishing for a cylindrical object deep in a well, a new fishing tool, and a new bridge plug element.

2 Claims, 5 Drawing Figures

METHOD AND BRIDGE PLUG FOR SEALING OFF A WELL

BACKGROUND OF THE INVENTION

For the production of oil from oil shale using radio frequency heating, the tubing in the RF field must be non-metallic, such as ceramic, and capable of high temperatures (400° C.+). Heating must be such that the oil shale temperature is maintained near, but not over, a maximum fixed value.

To permit the temperature measurements, a thermal well must be maintained through the heated zone. However, because of thermal expansion due to operating at these high temperatures, thermal expansion often causes thermal well tubing (ceramic) cracking and breaking. When this happens it becomes necessary to set a bridge plug near the broken section to prevent produced gases from flowing up the tube.

The materials of the bridge plug must be able to withstand the high operating temperatures and thus cannot be any of the elastomers.

This invention also includes a new method for fishing cylindrical objects from deep in a well.

Fishing is the operation to recover from a wellbore any equipment accidentally left there during drilling operations. Also it is the operation to remove certain items of equipment from an older well in order that the well may be reconditioned. In a well being drilled, the most common fishing operation is that required by the loss of a drill bit, one or more drill collars, or a part of the string of drill pipe. Additional items often fished from wells are packers, liners, screen pipe, etc. It may be noted that a great majority of these items are cylindrical. Thus to retrieve these items from deep in a well, a good, reliable, foolproof, and simple fishing tool is highly desired.

OBJECTS OF THE INVENTION

Accordingly, a primary object of this invention is to provide a new method for plugging or sealing off a section of tubing deep in a well by attaching a bridge plug to an anchor therein.

Another primary object of this invention is to provide a new bridge plug assembly responsive to an anchor for actuating the bridge plug for sealing thereof in a tubing deep in a well.

A further primary object of this invention is to provide a new method for fishing a cylindrical object from a tubing deep in a well by using a bead chain ringed plug.

A still further primary object of this invention is to provide a new fishing tool having a tapered plug for fishing a cylindrical object from a tubing deep in a well.

Another object of this invention is to provide a new bridge plug responsive to removal of a cover thereover for actuating the bridge plug into sealed position in a tubing deep in a well for sealing off a section thereof.

A further object of this invention is to provide a method and mechanism for sealing off a section of a tubing in a well that are easy to operate, have simple steps and of simple configuration, are economical to operate and to build and assemble, and are of greater efficiency for the sealing off of a tubing section.

Other objects and various advantages of the disclosed methods, bridging plug assembly, bridging plug, anchor, and fishing tool will be apparent from the following detailed description, together with the accompanying drawings, submitted for purposes of illustration only and not intended to define the scope of the invention, reference being made for that purpose to the surjoined claims.

SUMMARY OF THE INVENTION

Now new methods and articles for performing the methods have been discovered on how best to seal off a section of tubing deep in a well by (1) permanently anchoring a tapered anchor in the tubing by lowering a beaded chain ring thereover for wedging the anchor to the tubing at the desired position of sealing off the tubing, and (2) fixedly attaching a bridge plug to the tubing by actuation of attaching means for attaching and sealing the bridge plug to the tubing for sealing off the section of tubing at the desired position. A bridge plug assembly for performing the method is disclosed. Also, a method is disclosed for retrieving a cylindrical object from a well comprising the method steps of (1) lowering a tapered plug with a beaded chain ring therearound down the well into the hollow cylindrical object, and (2) rolling the beaded chain ring on the tapered plug until it wedges down between the internal cylindrical wall surface of the hollow cylindrical object and the tapered plug for retrieval thereof from the well with raising of the tapered plug. A fishing tool for performing the above method is also disclosed.

BRIEF DESCRIPTION OF THE DRAWINGS

The drawings diagrammatically illustrate by way of example, not by way of limitation, one form of the invention wherein like reference numerals designate corresponding parts in several views in which.

The invention disclosed herein, the scope of which being defined in the appended claims is not limited in its application to the details of construction and arrangement of parts shown and described, since the invention is capable of being in the form of other embodiments and of being practiced or carried out in various other ways. Also, it is to be understood that the phraseology or terminology employed here is for the purpose of description and not of limitation. Further, many modifications and variations of the invention as hereinafter set forth will occur to those skilled in the art. Therefore, all such modifications and variations which are within the spirit and scope of the invention herein are included and only such limitations should be imposed as are indicated in the appended claims.

METHOD FOR SEALING OFF A SECTION OF TUBING IN A WELL

On occasion, non-metallic tubing is utilized in a well wherein thermal expansion causes cracking and breaking of the tubing, particularly in ceramic tubing. The well must then be sealed off below the break for repair.

Thus a method for sealing off a section of the tubing comprises, (1) permanently anchoring a tapered anchor in the tubing by lowering a beaded chain ring thereover for wedging the anchor to the tubing at the desired position, and (2) fixedly attaching a bridge plug to the tubing by actuation of attaching means for attaching and sealing the bridge plug to the tubing for sealing off the section of tubing at the desired position.

The first method step of the above basic method may be expanded to include, (1) lowering a line into the tubing with the tapered anchor thereon, (2) lowering the tapered anchor with the beaded chain ring means therearound into the tubing to the location of the desired sealing off of the tubing section, (3) wedging the beaded chain down between the internal cylindrical wall surface of the tubing and the tapered anchor, and (4) raising the line to fixedly anchor the tapered anchor to the tubing at the location of the desired sealing off.

The second method step of the above basic method may be expanded to include, (1) restraining the bridge plug against upward movement by attaching it to the permanently anchored tapered anchor, and (2) fixedly attaching the bridge plug to the tubing at the desired position of seal off by actuating the bridge plug attaching means by moving a releasable means away from the permanently anchored tapered anchor.

THE PREFERRED EMBODIMENT FOR PRACTICING THE INVENTION

The above methods for sealing off a section of tubing in a well may be performed by other mechanisms than that disclosed in the FIGURES. The preferred system for performing the methods is disclosed in FIGS. 1–4.

Figure 1:
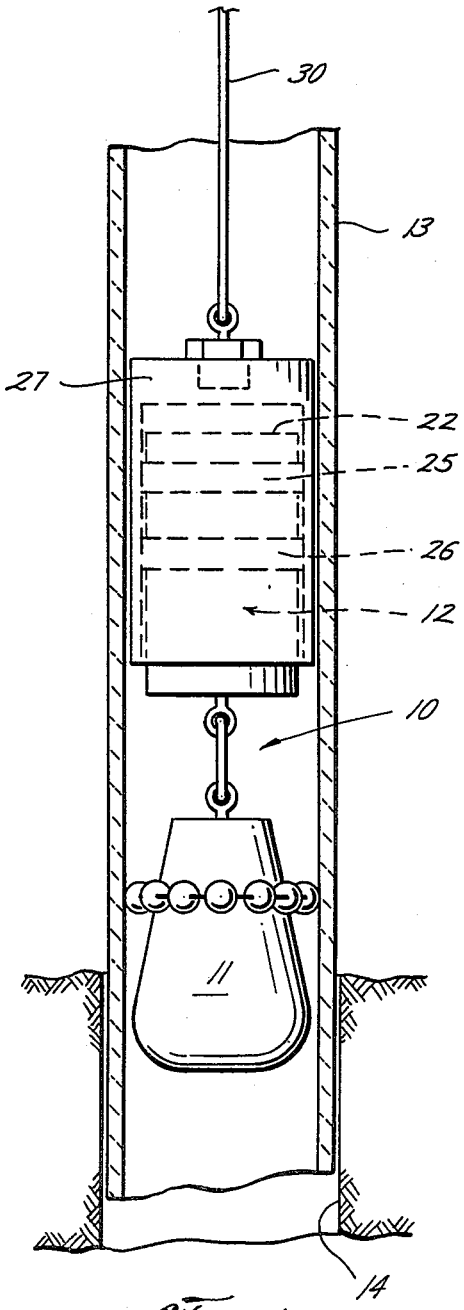
FIG. 1 is a schematic diagrammatic vertical sectional view of a bridge plug assembly being lowered in the well tubing.

FIG. 1 discloses the bridge plug assembly 10 comprising a non-retrievable anchor 11 connected to and for actuating a bridge plug 12 for sealing up or plugging a tubing 13 in a well 14.

Figure 2:
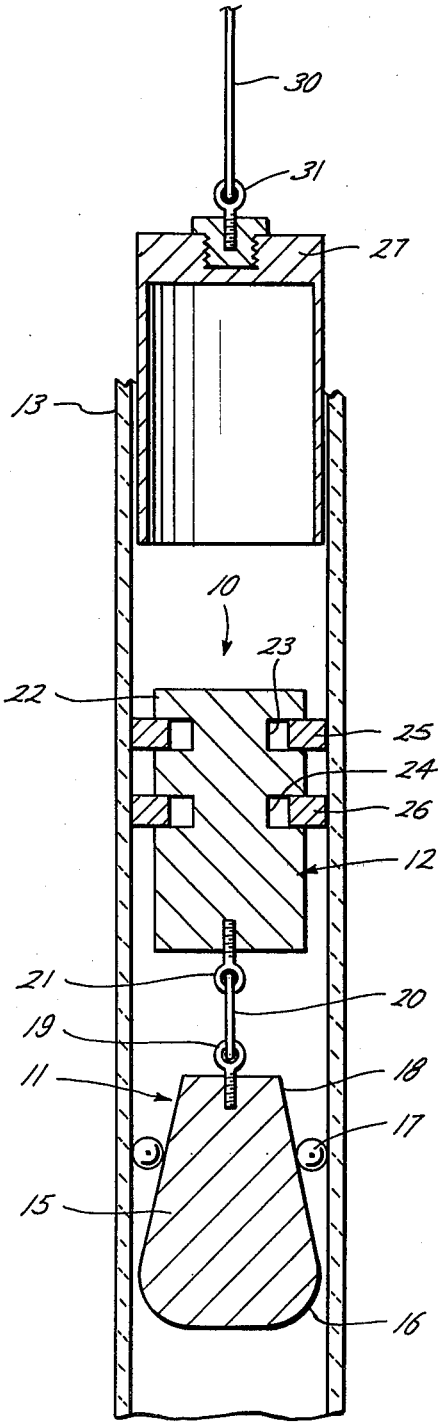
FIG. 2 is a sectional view like FIG. 1, but with the bridge plug assembly fixed in position with raising of the cover sleeve.

FIG. 2 particularly, shows the non-retrievable anchor 11 comprising a tapered plug 15 having rounded edges on the lower large end 16 for easily sliding down in the tubing. The tapered plug also has a beaded chain ring 17 laying loosely thereover which, in static position, will roll down the tapered surface of the plug to wedge between the plug tapered surface and the tubing internal surface, as illustrated in FIG. 2. Tapered plugs 15 of various sizes in diameter may be required to have on hand, as each different size tubing requires a tapered plug of slightly less diameter to insure that the beaded chain ring 17 will wedge between the plug and tubing.

The small end 18, FIG. 2, of the tapered plug 15 has a screw eye 19, or the like, secured therein. A suitable latch 20 interconnects the plug screw eye 19 and a screw eye 21, FIG. 3, on the bottom of the bridge plug 12.

Figure 3:
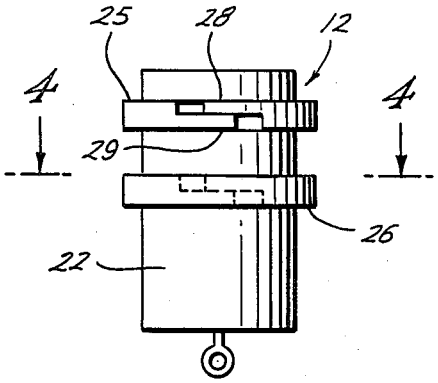
FIG. 3 is a schematic front view of the bridge plug per se with its sealing spring rings expanded.

Bridge plug 12, FIGS. 2 and 3 comprises a sealing plug 22 having grooves 23, 24, FIG. 2, therearound for slotted spring sealing rings 25, 26, respectively, therein. Each plug 22 is of a diameter great enough that in free expanded position, the rings press hard in sealing contact against the walls of the tubing 13. For lowering the plug 22 in the tubing, the rings 25, 26 and a sleeve cover 27, FIG. 1, is slid down over the plug 12 to retain the rings compressed in their grooves.

Each of the rings, as ring 25, FIG. 3, for example, has overlapping ends 28 and 29. This overlap insures that the ringed plug 22 or that the whole bridge plug 12 provides an air-tight and liquid-tight seal in the tubing.

Figure 4:
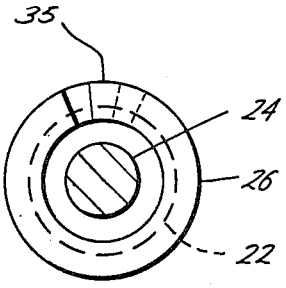
FIG. 4 is a section at 4—4 on FIG. 3.

FIG. 4, a section at 4—4 on FIG. 3, shows the expanded sealing ring 26 in its groove 24 with upper overlapping end 35, which sealing ring is similar to sealing ring 25.

A line 30, FIG. 2, extending down the well from the surface is tied to an eyelet connection 31, or the like, secured in the top of the sleeve 27 for lowering the bridge plug assembly 10 in the well tubing. The friction between the compressed rings and the sleeve secures the two together sufficiently to support the anchor 11 while hanging from the bottom of the sealing plug while all are lowered into the well tubing to the desired location.

Thus in operation, the sleeve 27, FIG. 2, is fitted over the bridge plug 22 for restraining the sealing rings 25, 26 in compressed retracted position, as illustrated in FIG. 1, and the anchor 11 is hung underneath the bridge plug 12, FIG. 1, prior to lowering the whole assembly into the well tubing 13. As the bridge plug assembly 10 is lowered in the tubing, it is stopped just below the flaw or break, or the like, in the tubing with the beaded chain ring rolling down and resting against both the anchor plug tapered surface and the tubing. Any upward pull on line 30 and on the anchor 10 will wedge the beaded chain ring between the anchor tapered plug surface and the tubing for preventing any upward movement of the anchor 10 and bridge plug 12 of the assembly 10. With raising of the sleeve 27 by raising line 30, the rings, 25, 26, instantly expand and seal the bridge plug 12 to the tubing with the anchor 11 preventing any upward movement of the sealing plug 12. Thus the well tubing is sealed off to prevent the escape of any gases or liquids.

METHOD FOR FISHING A HOLLOW CYLINDRICAL OBJECT FROM A WELL

The non-retrievable anchor 11, FIG. 1, for setting the bridge plug 12 of the combination bridge plug assembly 10 also has another and different use. It may be used as a fishing tool, 33, FIG. 5, for fishing up various cylindrical items, 32, inadvertently dropped in a well, 14 as a packer, liner, screen, pipe, etc., 32, FIG. 5.

Thus a method for fishing a hollow cylindrical object 32 from deep in a well comprises, (1) lowering a tapered plug (15) with a beaded chain ring (17) therearound down the well into the hollow cylinder object, and (2) wedging the beaded chain ring between the tapered plug and the internal cylindrical wall surface of the hollow cylindrical object for retrieval thereof from the well with raising of the tapered plug to the surface.

The first step of the above basic method may comprise further, (1) lowering a line (34) with the small end (18) of the tapered plug (15) attached thereto down in the well into the hollow cylindrical object (32).

The second step of the above basic method may comprise further, (1) raising the line (34) attached to the small end (18) of the tapered plug (15) after the bead chain ring (17) has wedged between the tapered plug and the cylindrical object (32) internal wall surface for retrieval thereof from the well.

ANOTHER EMBODIMENT FOR PRACTICING THE INVENTION

The above methods for fishing a cylindrical object from a well may be performed by other mechanisms than that disclosed in the FIGURES. But, the preferred device for performing the methods is disclosed in FIG. 5.

Cylindrical objects desired to be retrieved from a well may be a packer, liner, screen, pipe, etc. that were inadvertently dropped in the well.

Figure 5:
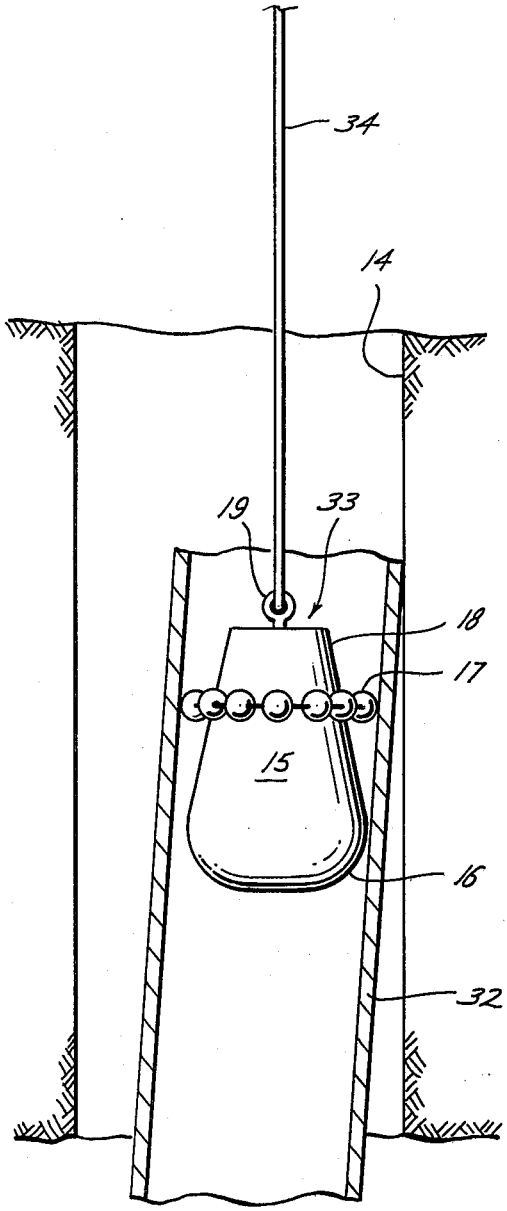
FIG. 5 is a schematic diagrammatic vertical view, partly in section, of the fishing tool attached to the cylindrical object deep in the well to be recovered.

FIG. 5 illustrates a cylindrical object 32 as described above in a well 14 to be retrieved by the new fishing tool 33. A line 34 from the surface is connected through a screw eye 19 in the small end of the tapered plug 15 for lowering the fishing tool 33 in the well down into the cylindrical object 32. With the diameter of the large end 16 of the plug 15 being only slightly less than that of the object to be fished out, the beaded chain ring 17 then rolls down the plug tapered surface to wedge between the internal surface of the object 32 to be fished out and the plug tapered surface. As long as a steady upward force is applied to the fishing tool plug 15, the beaded chain ring 17 maintains the object locked on for recovery at the surface.

Thus accordingly, it will be seen that the disclosed methods, bridge plug assembly, and anchor operate in a manner which meets each of the objects set forth hereinbefore.

This invention is particularly useful in ceramic pipe for use in the production of oil from oil shale using Radio Frequency Heating.

While only two embodiments of the invention have been disclosed, it will be evident that various other modifications are possible in the arrangement and construction of the disclosed bridge plug assembly and anchor without departing from the scope of the invention, and it is accordingly desired to comprehend within the purview of this invention such modifications as may be considered to fall within the scope of the appended claims.

We claim:

1. A bridge plug assembly adapted for sealing off a section of non-metallic tubing in a well comprising,
   (a) body means,
   (b) attaching means for securing said body means to said non-metallic tubing without damaging the non-metallic tubing comprising,
   at lease one flexible sealing ring having overlapping ends fitted in a groove circumscribing said body means,
   (c) releasable means for actuating said attaching means to body securing state,
   (d) anchor means for restraining upward movement of said body means in said tubing, and
   (e) said releasable means being responsive to upward movement thereof for actuating said attaching means for securing said body means to said non-metallic tubing for sealing off the lower section thereof.

2. A bridge plug as recited in claim 1 wherein said releasable means comprises,
   (a) cap means slidable over said body means and said sealing ring for compressing said ring to permit free movement of said body means in said tubing, and
   (b) said cap means being responsive to upward actuation thereof for releasing said compressed sealing ring for thus fixedly attaching and sealing said body means to said non-metallic tubing.

* * * * *